US006575561B1

(12) United States Patent
Silverbrook

(10) Patent No.: US 6,575,561 B1
(45) Date of Patent: Jun. 10, 2003

(54) MODULAR PRINTHEAD ALIGNMENT SYSTEM

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 10/129,436

(22) PCT Filed: Mar. 9, 2001

(86) PCT No.: PCT/AI01/00261

§ 371 (c)(1),
(2), (4) Date: May 6, 2002

(87) PCT Pub. No.: WO01/67514

PCT Pub. Date: Sep. 13, 2001

(30) Foreign Application Priority Data

Mar. 9, 2000 (AU) ..... PQ 6110

(51) Int. Cl.[7] ..... B41J 2/04

(52) U.S. Cl. ..... 347/54

(58) Field of Search ..... 347/54, 68, 69, 347/70, 71, 72, 50, 40, 20, 44, 47, 27, 63; 399/261; 361/700; 29/890.1; 310/328–330

(56) References Cited

U.S. PATENT DOCUMENTS 5,075,201 A 12/1991 Koh
5,942,805 A 8/1999 Winer et al.

FOREIGN PATENT DOCUMENTS

EP 0 865 923 A2 9/1998

*Primary Examiner*—Raquel Yvette Gordon

(57) ABSTRACT

Optically aligning a silicon chip (1, 2) with respect to a frame of reference, the chip (1, 2) having a protective guard (3, 4) covering delicate microscopic structures on its surface, by using fiducials (5, 6) on the surface to optically align the chip (1, 2) with a microscope and forming the guard (3, 4) without compromising the protection it provides.

11 Claims, 1 Drawing Sheet

MODULAR PRINTHEAD ALIGNMENT SYSTEM

FIELD OF THE INVENTION

The present invention relates to the micron-scale alignment of components and in particular, the precise alignment of modular inkjet printheads manufactured using micro electro mechanical system (MEMS) techniques.

CO-PENDING APPLICATIONS

Various methods, systems and apparatus relating to the present invention are disclosed in the following co-pending applications filed by the applicant or assignee of the present invention on May 24, 2000:

| | | | |
|---|---|---|---|
| PCT/AU00/00578 | PCT/AU00/00579 | PCT/AU00/00581 | PCT/AU00/00580 |
| PCT/AU00/00582 | PCT/AU00/00587 | PCT/AU00/00588 | PCT/AU00/00589 |
| PCT/AU00/00583 | PCT/AU00/00593 | PCT/AU00/00590 | PCT/AU00/00591 |
| PCT/AU00/00592 | PCT/AU00/00584 | PCT/AU00/00585 | PCT/AU00/00586 |
| PCT/AU00/00594 | PCT/AU00/00595 | PCT/AU00/00596 | PCT/AU00/00597 |
| PCT/AU00/00598 | PCT/AU00/00516 | PCT/AU00/00517 | PCT/AU00/00511 |

Various methods, systems and apparatus relating to the present invention are disclosed in the following co-pending application, PCT/AU00/01445, filed by the applicant or assignee of the present invention on Nov. 27, 2000. The disclosures of these co-pending applications are incorporated herein by cross-reference. Also incorporated by cross-reference, are the disclosures of two co-pending PCT applications filed Mar. 2, 2001, application numbers PCT/AU01/00216 and PCT/AU01/00217 (deriving priority from Australian Provisional Patent Application Nos. PQ5959 and PQ5957).

BACKGROUND OF THE INVENTION

The present invention is particularly well suited to the assembly of CMOS (complementary metal oxide semiconductor) devices such as silicon computer chips. The invention will be described with particular reference to silicon printhead chips for digital inkjet printers wherein the nozzles, chambers and actuators of the chip are formed using MEMS techniques. However, it will be appreciated that this is in no way restrictive and the invention may also be used in many other applications.

Silicon printhead chips are well suited for use in pagewidth printers having stationary printheads. These printhead chips extend the width of a page instead of traversing back and forth across the page, thereby increasing printing speeds. The probability of a production defect in an eight inch long chip is much higher than a one inch chip. The high defect rate translates into relatively high production and operating costs.

To reduce the production and operating costs of pagewidth printers, the printhead may be made up of a series of separate printhead modules mounted adjacent one another, each module having its own printhead chip. To ensure that the printing produced is continuous across the width of the page, the chip in each module must be accurately aligned with the chips on adjacent modules. To assist with the alignment of adjacent chips, reference markings known as "fiducials" are provided on each chip for optical alignment using a microscope.

The microscopic ink-nozzle structures are very fragile and may be damaged by unintentional contact. In situations requiring a certain level of robustness, the printhead chips have a protective guard to shield the ink nozzles. Unfortunately, the protective guard obscures the fiducials from the microscope.

SUMMARY OF THE INVENTION

According to a first aspect, the present invention provides a method of positioning a silicon chip, wherein the chip has a protective guard covering at least part of a surface of the chip, the method including:

- providing at least one fiducial on the surface of the chip beneath the guard,
- providing an aperture in the guard above the fiducial, the aperture being sized so as not to compromise effective protection provided by the guard; and,
- viewing the fiducial through the aperture with a microscope to accurately position the chip.

Preferably, the chip is a MEMS inkjet printhead chip to be positioned so that its printing aligns with that of an adjacent printhead chip on an inkjet printer printhead. In a further preferred form, the printhead is a pagewidth printhead.

According to a second aspect, the present invention provides a silicon chip including:

- a protective guard covering at least part of a surface of the chip;
- a fiducial on the surface of the chip beneath the guard;
- an aperture in the guard above the fiducial allowing it to be viewed by a microscope for the purpose of accurately positioning the chip; wherein,
- the aperture is sized to accommodate the beam angle of the microscope without compromising the protection provided by the guard.

According to a third aspect, the present invention provides a method of accurately positioning a silicon chip wherein the chip has a protective guard covering at least part of a surface of the chip, the method including:

- forming the guard from an infrared transparent material;
- providing a fiducial on the surface of the chip beneath the guard for viewing with an infrared microscope to accurately position the chip.

According to another aspect, the present invention provides a silicon chip including:

- a protective surface guard formed from an infrared transparent material;
- a fiducial on the surface of the chip beneath the guard; wherein,
- the fiducial is visible through the guard when viewed by an infrared microscope.

Preferably the infrared transparent material is silicon.

In one embodiment, the chip is a printhead chip for use in a pagewidth inkjet printer having a plurality of adjacent printhead chips.

It will be appreciated that using an appropriately sized aperture in the protective guard for forming the guard from a material that is transparent to the radiation sensed by the microscope, the present invention provides a convenient system for the precise alignment of silicon chips with guard structures without comprising the protection of the delicate nozzle structures on the chip surface.

BRIEF DESCRIPTION OF THE DRAWINGS

A preferred embodiment of the present invention will now be described by way of example only with reference to the accompanying drawings in which.

DETAILED DESCRIPTION OF THE PREFERRED EMBODIMENTS

Figure 1:
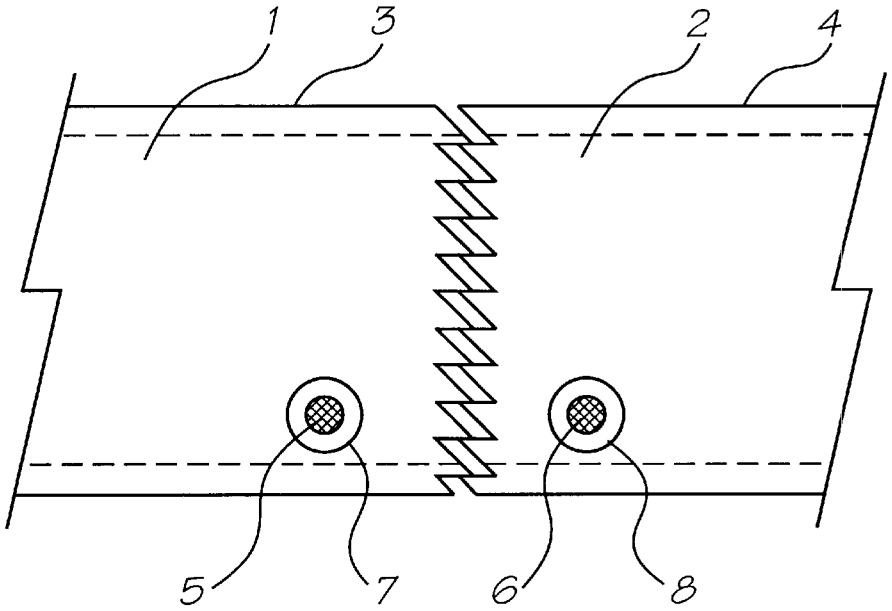
FIG. 1 is a schematic view of adjacent silicon chips with fiducial marks for alignment using a first embodiment of the invention; and, FIG. 2 is a schematic view of adjacent silicon chips with fiducial marks for alignment using another embodiment of the present invention.

Referring to FIG. 1, adjacent printhead chips 1 and 2 are provided with respective protective guards 3 and 4. In order to accurately align the printing from each printhead chip, fiducials 5 and 6 are provided on each chip as points of reference that can be sighted through a microscope.

The protective guards 3 and 4 prevent inadvertent contact with the fragile inkjet nozzles (not shown) on each chip. Apertures 7 and 8 in each of the protective guards are positioned to expose the fiducials 5 and 6 and sized so that they are big enough to accommodate the beam angle of the microscope and yet allow the guard to remain an effective guard against inadvertent contact with the nozzles.

Figure 2:
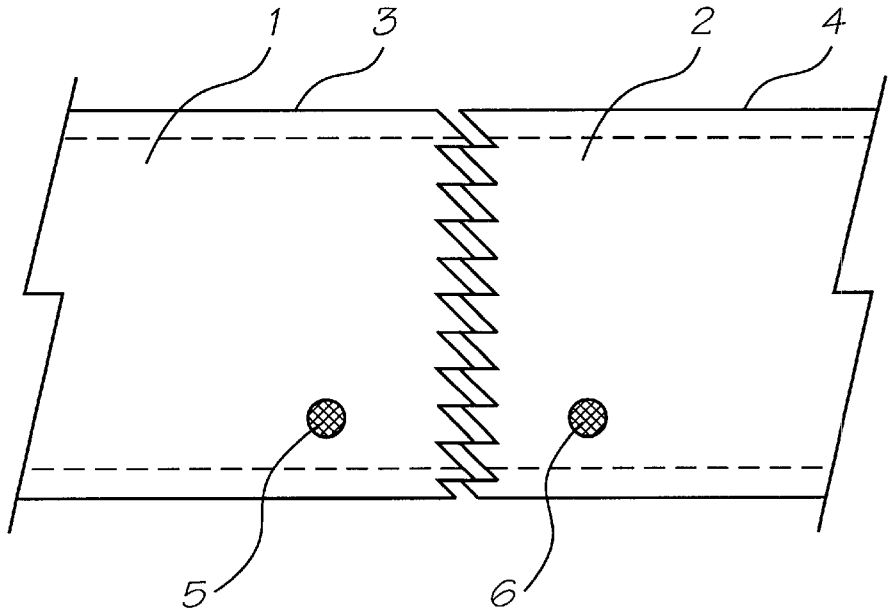

Referring to FIG. 2, the adjacent printhead chips 1 and 2 also have respective protective guards 3 and 4 and fiducials 5 and 6. Instead of forming apertures in the protective guards, the guards are formed from silicon such that the fiducials may still be viewed by an infrared microscope. It will be appreciated that by using a material that is transparent to infrared light such as silicon, an infrared microscope may be used to align adjacent printhead chips without compromising the protection provided by the guards.

The invention has been described herein with reference to specific embodiments. Skilled workers in this field will readily recognize that the invention may be embodied in many other forms.

What is claimed is:

1. A method of positioning a silicon chip, wherein the chip has a protective guard covering at least part of a surface of the chip, the method including:

providing at least one fiducial on the surface of the chip beneath the guard;

providing an aperture in the guard above the fiducial, the aperture being sized so as not to compromise effective protection provided by the guard; and, viewing the fiducial through the aperture with a microscope to accurately position the chip.

2. A method of positioning a silicon chip according to claim 1 wherein the chip is a MEMS inkjet printhead chip to be positioned so that its printing aligns with that of an adjacent printhead chip on an inkjet printer printhead.

3. A method of positioning a silicon chip according to claim 2 Wherein the printhead is a page width printhead.

4. A silicon chip including:

a protective guard covering at least part of a surface of the chip;

a fiducial on the surface of the chip beneath the guard;

an aperture in the guard above the fiducial allowing it to be viewed by a microscope for the purpose of accurately positioning the chip; wherein the aperture is sized to accommodate the beam angle of the microscope without compromising the protection provided by the guard.

5. A silicon chip according to claim 4 wherein the chip is a MEMS inkjet printhead chip for positioning so that its printing aligns with that of an adjacent printhead chip on an inkjet printer printhead.

6. A method of positioning a silicon chip wherein the chip has a protective guard covering at least part of a surface of the chip, the method including forming the guard from an infrared transparent material;

providing a fiducial on the surface of the chip beneath the guard for viewing with an infrared microscope to accurately position the chip.

7. A method of positioning a silicon chip according to claim 6 wherein the chip is a MEMS inkjet printhead chip to be positioned so that its printing aligns with that of an adjacent printhead chip on an inkjet printer printhead.

8. A method of positioning a silicon chip according to claim 7 wherein the printhead is a pagewidth printhead.

9. A silicon chip including:

a protective surface guard formed from an infrared transparent material a fiducial on the surface of the chip beneath the guard;

wherein the fiducial is visible through the guard when viewed by an infrared microscope.

10. A silicon chip according to claim 9 wherein the infrared transparent material is silicon.

11. A silicon chip according to claim 10 wherein the chip is a printhead chip for use in a pagewidth inkjet printer having a plurality of adjacent printhead chips.

* * * * *

UNITED STATES PATENT AND TRADEMARK OFFICE

CERTIFICATE OF CORRECTION

PATENT NO. : 6,575,561 B1
DATED : June 10, 2003
INVENTOR(S) : Kia Silverbrook

It is certified that error appears in the above-identified patent and that said Letters Patent is hereby corrected as shown below:

Title page,
Item [86], the PCT No. should read:
-- [86] PCT No.: PCT/AU01/00261 --

Signed and Sealed this

Seventh Day of October, 2003

JAMES E. ROGAN
*Director of the United States Patent and Trademark Office*